US008816955B2

(12) United States Patent
Kang et al.

(10) Patent No.: US 8,816,955 B2
(45) Date of Patent: Aug. 26, 2014

(54) DISPLAY APPARATUS AND METHOD FOR IMPROVING IMAGE QUALITY THEREOF

(75) Inventors: Jeong-il Kang, Yongin-si (KR); Kun-ho Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 262 days.

(21) Appl. No.: 13/179,644

(22) Filed: Jul. 11, 2011

(65) Prior Publication Data

US 2012/0105518 A1 May 3, 2012

(30) Foreign Application Priority Data

Nov. 1, 2010 (KR) ..... 10-2010-0107623

(51) Int. Cl.
*G09G 3/36* (2006.01)
*G09G 5/02* (2006.01)

(52) U.S. Cl.
USPC ..... 345/102; 345/690; 345/694; 315/295

(58) Field of Classification Search
USPC ..... 345/102, 690, 694; 315/295
See application file for complete search history.

(56) References Cited

U.S. PATENT DOCUMENTS

| | | | | |
|---|---|---|---|---|
| 3,796,951 | A * | 3/1974 | Joseph | 324/122 |
| 5,663,719 | A * | 9/1997 | Deese et al. | 340/912 |
| 6,340,992 | B1 * | 1/2002 | Markandey | 348/556 |
| 6,903,716 | B2 * | 6/2005 | Kawabe et al. | 345/99 |
| 7,973,877 | B2 * | 7/2011 | Takeda et al. | 349/61 |
| 2005/0168965 | A1 * | 8/2005 | Yoshida | 362/3 |
| 2006/0038803 | A1 * | 2/2006 | Miller et al. | 345/204 |
| 2006/0082536 | A1 * | 4/2006 | Koyama et al. | 345/100 |
| 2006/0132474 | A1 * | 6/2006 | Lam | 345/204 |
| 2007/0001619 | A1 * | 1/2007 | Kang et al. | 315/247 |
| 2007/0103905 | A1 * | 5/2007 | Kang et al. | 362/276 |
| 2007/0195023 | A1 * | 8/2007 | Kang et al. | 345/82 |
| 2007/0205977 | A1 * | 9/2007 | Kim | 345/102 |
| 2007/0257623 | A1 * | 11/2007 | Johnson et al. | 315/193 |
| 2007/0268234 | A1 * | 11/2007 | Wakabayashi et al. | 345/102 |
| 2007/0285379 | A1 * | 12/2007 | Jung et al. | 345/102 |
| 2009/0168455 | A1 * | 7/2009 | Kim et al. | 362/613 |
| 2009/0290093 | A1 * | 11/2009 | Shimura et al. | 349/62 |
| 2010/0165252 | A1 * | 7/2010 | Tsujii | 349/65 |
| 2010/0231578 | A1 * | 9/2010 | Yamashita | 345/213 |
| 2010/0259694 | A1 * | 10/2010 | Kim et al. | 348/790 |

(Continued)

OTHER PUBLICATIONS

Christiansen, Donald; "Electronics Engineers' Handbook;" 1997; McGraw Hill; Fourth Edition; pp. 10.36-10.40.*

(Continued)

*Primary Examiner* — Amare Mengistu
*Assistant Examiner* — Crystal A Mathews
(74) *Attorney, Agent, or Firm* — Sughrue Mion, PLLC

(57) ABSTRACT

A display apparatus includes a liquid crystal panel; a light guide plate disposed at a rear side of the liquid crystal panel; at least one LED module disposed in at least one side of the light guide plate and including a plurality of LEDs; a driver which drives the plurality of LEDs; an image analyzer which analyzes an input image; and a switch unit which turns off at least one LED among the plurality of LEDs while a remainder of the plurality of LEDs are being driven by the driver, according to a result of the analyzing the input image, wherein the at least one LED is disposed closer to a corner of the liquid crystal panel than the remainder of the plurality of LEDs.

16 Claims, 10 Drawing Sheets

(56) References Cited

U.S. PATENT DOCUMENTS

| | | | | |
|---|---|---|---|---|
| 2010/0283719 | A1* | 11/2010 | Chou | 345/102 |
| 2011/0050742 | A1* | 3/2011 | Lee et al. | 345/690 |
| 2011/0063276 | A1* | 3/2011 | Tan et al. | 345/212 |
| 2011/0068701 | A1* | 3/2011 | van de Ven et al. | 315/185 R |
| 2011/0084619 | A1* | 4/2011 | Gray et al. | 315/185 R |
| 2011/0090259 | A1* | 4/2011 | Kang et al. | 345/690 |
| 2011/0102452 | A1* | 5/2011 | Yun et al. | 345/589 |
| 2011/0122167 | A1* | 5/2011 | Kim et al. | 345/690 |
| 2012/0105498 | A1* | 5/2012 | Kim et al. | 345/690 |
| 2012/0105518 | A1* | 5/2012 | Kang et al. | 345/694 |

OTHER PUBLICATIONS

Halliday et al.; "Fundamentals of Physics;" 2003; John Wiley & Sons, Inc.; Sixth Edition; pp. 617-619.*

* cited by examiner

DISPLAY APPARATUS AND METHOD FOR IMPROVING IMAGE QUALITY THEREOF

CROSS-REFERENCE TO RELATED APPLICATIONS

This application claims priority from Korean Patent Application No. 10-2010-0107623, filed Nov. 1, 2010, the disclosure of which is incorporated herein by reference in its entirety.

BACKGROUND

1. Field

Apparatuses and methods consistent with exemplary embodiments relate to a display and image quality improvement, and more specifically, to a display apparatus, having edge-type light emitting diodes (LEDs) as a light source, which prevents light leakage, and a method for improving image quality of the display apparatus by preventing the light leakage.

2. Description of the Related Art

In general, a liquid crystal display (LCD) which is a representative example of display apparatuses, is used to display images on a monitor such as television (TV) or notebook computer. Since the LCD cannot produce light by itself, it should use light emitting from a separate light source.

Mostly, the LCD includes a backlight as the light source in a rear side of a display panel. By controlling transmittance of the light coming from the backlight according to movement of the liquid crystal, the LCD displays images.

The LCD can display the images using edge-type LEDs, disposed on at least one edge of the display panel, as the light source, instead of a direct type light source disposed in the rear side of the display panel.

When an image is displayed using the edge-type LEDs, light leakage takes place in corners of a display screen. The light leakage indicates blurring in part of the display screen of the LCD, compared to other regions.

When the display screen gets darker, the corner regions are more vulnerable to the light leakage, thereby to deteriorate the quality of a displayed image. Thus, it is necessary to prevent the light leakage to improve the image quality.

SUMMARY

One or more exemplary embodiments provide a display apparatus for turning off at least one LED corresponding to a corner region of a display screen, and a method for improving image quality of the display apparatus.

According to an aspect of an exemplary embodiment, a display apparatus includes a liquid crystal panel; a light guide plate disposed in a rear side of the liquid crystal panel; at least one LED module disposed in at least one side of the light guide plate and including a plurality of LEDs; a driver which drives the plurality of the LEDs; an image analyzer which analyzes an input image; and a switch unit which turns off at least one LED among the plurality of LEDs while a remainder of the plurality of LEDs is being driven by the driver, according to a result of the analyzing the input image, wherein the at least one LED is disposed closer to a corner of the liquid crystal panel than the remainder of the plurality of LEDs.

The at least one LED module may include a first terminal, a second terminal, and a third terminal. The first terminal is connected to an anode of a first LED placed at one end of the plurality of LEDs connected in series, the second terminal is connected to a cathode of the first LED, and the third terminal is connected to a cathode of a last LED placed at the other end of the plurality of LEDs connected in series.

The first terminal may be connected to a plus terminal of the driver, and the third terminal may be connected to a minus terminal of the driver.

The switch unit may include a first resistor, a second resistor, a third resistor, a first transistor, and a second transistor. The first resistor is connected to the first terminal at one end and to a first node with the other end, the second resistor is connected to the first node at one end and to a second node at the other end, and the third resistor is connected to the first node at one end and to a third node at the other end. The first transistor is connected to the third node at a gate terminal, to the first terminal at a source terminal, and to the second terminal at a drain terminal. The second transistor is connected to the second node at a drain terminal, an external signal being applied to a gate terminal of the second transistor, and a source terminal of the second transistor being grounded.

The first transistor may be a P-channel metal oxide semiconductor (PMOS) and the second transistor may be an N-channel metal oxide semiconductor (NMOS).

The external signal may be a control signal which controls not to apply current to the at least one LED, based on a result of the analyzing the input image.

The at least one LED module may include a first LED module and a second LED module, and the plurality of LEDs may include a first plurality of LEDs included in the first LED module and a second plurality of LEDs included in the second LED module. The first LED module may include a first terminal, a second terminal, a third terminal, and a fourth terminal. The first terminal is connected to a cathode of a first LED placed at one end of the first plurality of LEDs connected in series, the second terminal is connected to an anode of the first LED, the third terminal is connected to an anode of a second LED connected to the first LED, and the fourth terminal is connected to a cathode of a last LED placed at the other end of the first plurality of LEDs connected in series.

The second LED module may have the same structure as the first LED module.

The switch unit may turn off the at least one LED while the remainder of the plurality of LEDs are being driven by the driver if the image analyzer determines at least one of (i) that the input image to be displayed on the liquid crystal panel is in a given format; and (ii) that a pixel value of the input image to be displayed at the corner of the liquid crystal panel is lower than a pixel value of the input image to be displayed at a neighbor region.

The given format may be a letterbox format.

The display apparatus may further include a storage unit which pre-stores information about the at least one LED to be turned off according to the result of the analyzing the input image.

The pre-stored information about the at least one LED to be turned off may include information about at least one of a location of the at least one LED in the at least one LED module and a number of the at least one LED among the plurality of LEDs.

The display apparatus may further include a user input unit which receives a user command to control the switch unit to turn off the at least one LED without regard to the result of the analyzing the input image.

According to an aspect of another exemplary embodiment, a method for improving image quality of a display apparatus which includes a liquid crystal panel, a light guide plate disposed at a rear side of the liquid crystal panel, and at least one LED module disposed in at least one side of the light guide plate and including a plurality of LEDs, the method including driving the plurality of LEDs; analyzing an input image; and turning off at least one LED among the plurality of LEDs while a remainder of the plurality of LEDs are being driven, according to a result of the analyzing the input image, wherein the at least one LED is disposed closer to a corner of the liquid crystal panel than the remainder of the plurality of LEDs.

According to an aspect of yet another exemplary embodiment, a display apparatus includes a display substrate on which an input image is displayed; a light guide disposed at a rear side of the display substrate; at least one light source module disposed in at least one side of the light guide and comprising a plurality of light sources; and a controller which turns on and off at least one light source among the plurality of light sources while a remainder of the plurality of light sources are turned on to display the input image on the display substrate.

The display apparatus may further include at least one of an image analyzer, which analyzes the input image, and a user input which receives a user command, wherein the at least one light source to be turned on and off is selected by the controller according to a result of the analyzing the input image or the user command.

The controller may turn off the at least one light source while the remainder of the plurality of light sources are turned on to display the input image, if it is determined that light leakage blurring the display substrate is to occur at a region of the display substrate which is disposed closer to the at least one light source than a remaining region of the display substrate.

The controller may turn off the at least one light source while the remainder of the plurality of light sources are turned on to display the input image if the image analyzer determines at least one of: (i) that the input image to be displayed on the display substrate is in a given format; and (ii) that a pixel value of the input image to be displayed at a region in the display substrate corresponding to the at least one light source is lower than a pixel value of the input image to be displayed at a neighbor region in the display substrate.

BRIEF DESCRIPTION OF THE DRAWINGS

The above and/or other aspects will become more apparent by describing certain exemplary embodiments with reference to the accompanying drawings, in which.

DETAILED DESCRIPTION OF EXEMPLARY EMBODIMENTS

Exemplary embodiments are described in greater detail below with reference to the accompanying drawings.

The matters defined in the description, such as detailed construction and elements, are provided to assist in a comprehensive understanding of the exemplary embodiments. However, the exemplary embodiments can be practiced without those specifically defined matters. Also, well-known functions or constructions are not described in detail since they would obscure the inventive concept with unnecessary detail.

Figure 1:
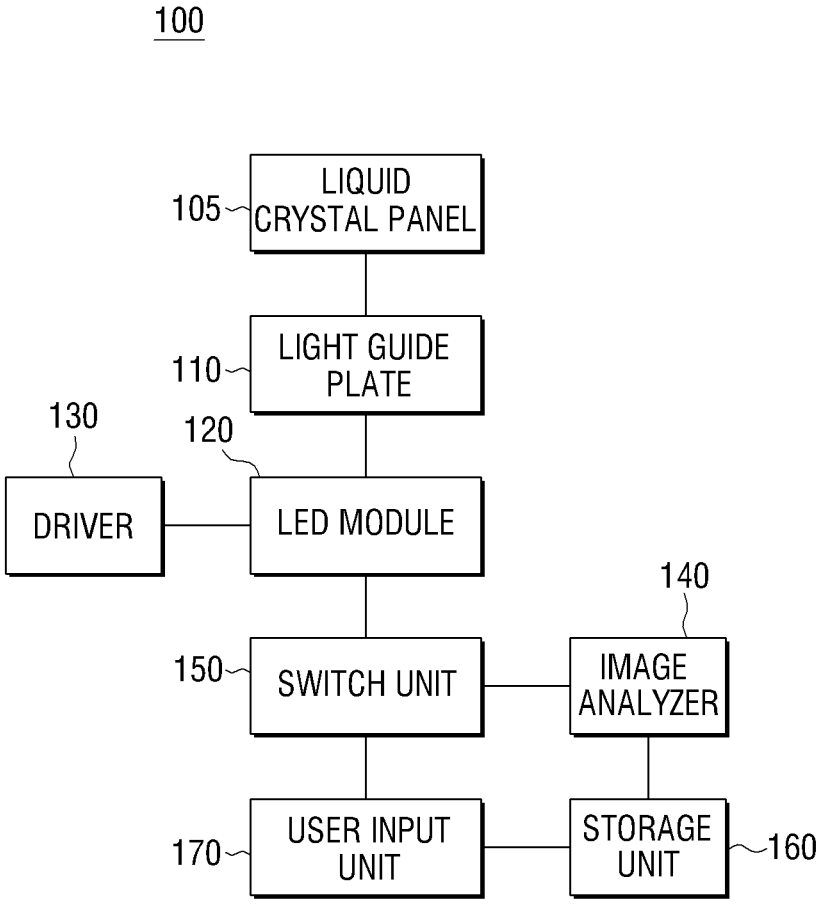
FIG. 1 illustrates a display apparatus according to an exemplary embodiment.

FIG. 1 illustrates a block diagram of a display apparatus according to an exemplary embodiment.

Referring to FIG. 1, a display apparatus 100 includes a liquid crystal panel 105, a light guide plate 110, at least one LED module 120, a driver 130, an image analyzer 140, and a switch unit 150.

The light guide plate 110 is placed in parallel with the liquid crystal panel 105 in the rear side of the liquid crystal panel 105. The light guide plate 110 is formed of a transparent material to pass light produced from the at least one LED module 120. The light guide plate 110 can be formed in a plate structure.

The at least one LED module 120 is disposed in at least one side of the light guide plate 110, and includes a plurality of LEDs.

The LEDs can be white LEDs for producing, but not limited to, white light. The LEDs can employ a blue LED, a green LED, a red LED, and so on.

The driver 130 drives the LEDs by applying current to the LEDs to turn on the LEDs.

The image analyzer 140 analyzes an input image. More specifically, the image analyzer 140 can analyze the input image and check whether the display apparatus 100 needs to process image improvement to prevent light leakage.

The image analyzer 140 checks whether the input image is a letterbox format image, whether a sum of entire pixel values of the input image is smaller than a preset value, whether the input image is quite dark on the whole, whether a corner region of the liquid crystal panel 105 has no or little data, whether the pixel value of the input image at the corner region of the liquid crystal panel is lower than the pixel value of the input image at the neighbor region, and whether the input image is a movie, and so on.

To analyze the input image as above, various methods well known in the art can be applied.

According to a result of the image analysis, the switch unit 150 turns off at least one LED close to a corner region of the liquid crystal panel 105 among the plurality of the LEDs.

While it is advantageous that the switch unit 150 turns off one LED closest to the corner region of the liquid crystal panel 105 among the LEDs, the switch unit 150 may turn off two or more LEDs.

Here, the at least one LED to be turned off can be an LED used to control the image displayed in the corner region of the display apparatus 100.

The switch unit 150 does not apply current to at least one LED by diverting the current applied from the driver 130.

According to an exemplary embodiment, the display apparatus 100 may further include a storage unit 160 connected to the image analyzer 140. The storage unit 160 may pre-store information used by the image analyzer 140 to analyze the input image. This pre-stored information may also be input by a user through a user input unit 170, according to an exemplary embodiment. Based on the image analysis by the image analyzer 140 using the information (e.g., comparing the input image with the pre-stored information), the switch unit 150 may turn off the at least one LED in displaying the input image. For example, the storage unit 160 may pre-store information which the image analyzer 140 compares with the input image to determine whether the input image is the letterbox format image and/or information which the image analyzer 140 uses to determine whether the pixel value of the input image at the corner region of the liquid crystal panel is lower than the pixel value of the input image at the neighbor region. According to an exemplary embodiment, the storage unit 140 may also pre-store information about the at least one LED to be turned off according to the image analysis by the image analyzer 140. The pre-stored information about the at least one LED may include information about a location and/or a number of the at least one LED to be turned off.

The display apparatus 100 may further include a user input unit 160 which receives a user command, according to an exemplary embodiment. The user input unit may be connected to the switch unit 150 to control the switch unit 150 to turn off the at least one LED close to the corner region of the liquid crystal panel 105 at the user command. At this time, the switch unit 150 can turn off the at least one LED according to the input user command. Hence, regardless of the analysis of the input image, the display apparatus 100 can process image improvement manually to prevent the light leakage based on the user command.

In the display apparatus 100, the driver 130 and the switch unit 150 can constitute a controller (not shown). The controller (not shown) can control the LED module 120 to turn on or off the at least one LED close to the corner region of the liquid crystal panel 105 among the plurality of the LEDs.

Unlike the structure of FIG. 1, the controller (not shown) can be modified to control the liquid crystal panel 105, the light guide plate 110, the at least one LED module 120 and the image analyzer 140.

It is preferable, but not necessary, that the display apparatus 100 is a liquid crystal display apparatus. The display apparatus 100 can employ edge-type LEDs disposed at least one side of the light guide plate 110.

Thus, a display apparatus according to another exemplary embodiment can include a liquid crystal panel, a light guide plate disposed in parallel with the liquid crystal panel in the rear side of the liquid crystal panel, at least one LED module disposed in at least one side of the light guide plate and including a plurality of LEDs, and a controller for controlling the at least one LED module to turn on or off at least one LED, among the LEDs, close to a corner region of the liquid crystal panel.

Figure 2:
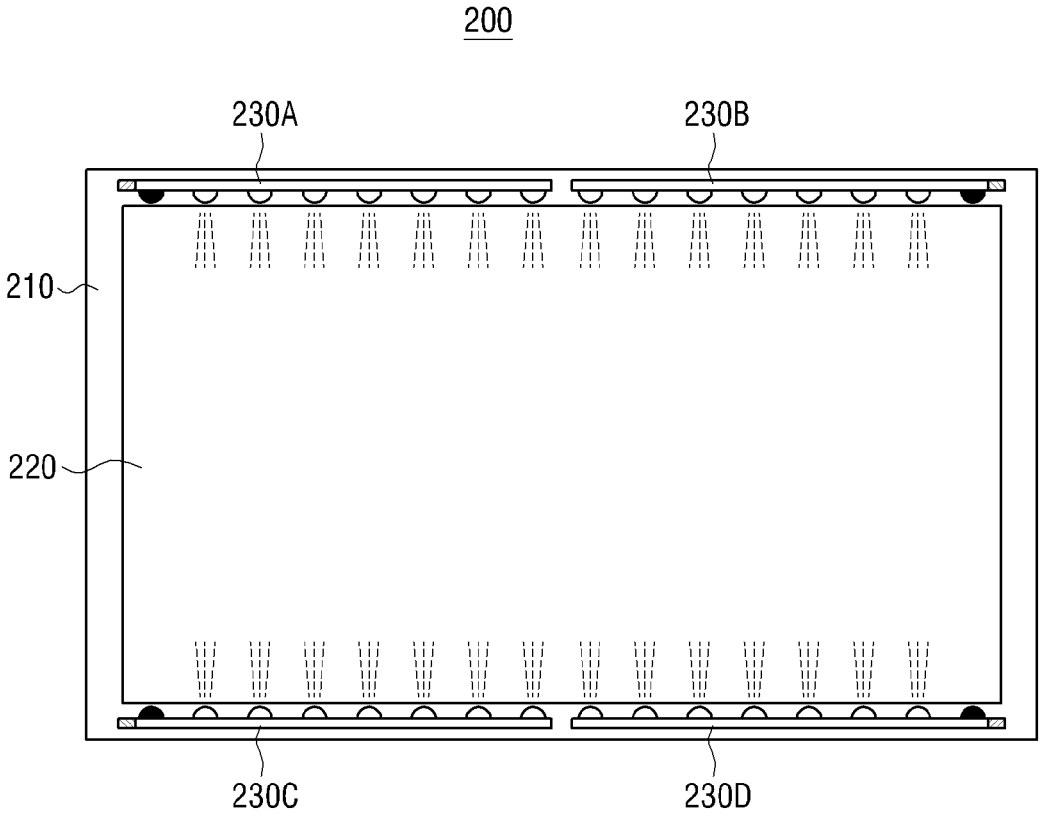
FIG. 2 illustrates a rear view of a display apparatus which corresponds to the display apparatus 100 of FIG. 1, according to an exemplary embodiment.

FIG. 2 illustrates a rear view of a display apparatus which corresponds to the display apparatus 100 of FIG. 1, according to an exemplary embodiment.

Referring to FIG. 2, the display apparatus 200 employing edge-type LEDs includes a liquid crystal panel 210, a light guide plate 220 disposed in a rear side of the liquid crystal panel 210, and LED modules 230A through 230D disposed at sides of the light guide plate 220.

The LED modules 230A through 230D can be arranged at the upper side and the lower side of the light guide plate 220 as shown in FIG. 2. However, any number of LED modules such as the LED modules 230A through 230D can be arranged at any two, three or all four of the upper side, the lower side, the right side and the left side of the light guide plate 220, according to other exemplary embodiments.

Among the LED modules 230A through 230D, the LED modules 230A and 230B placed in the upper side can be constructed as a single module unlike FIG. 2, or as multiple modules as the screen size of the display apparatus 200 increases. This also applies to the LED modules 230C and 230D placed in the lower side among the LED modules 230A through 230D.

The light guide plate 220 can be of a hexahedral plate structure. The light guide plate 220 uniformly spreads light emitting from the LED modules 230A through 230D to maintain uniformity of luminance and color in the liquid crystal panel 210 and uniformly guide the incident light straight to the liquid crystal panel 210.

Since the display apparatus 200 adopts the edge-type LEDs, light leakage can blur the corner region of the liquid crystal panel 210, compared to the other regions of the displayed screen. To improve the image quality by preventing the light leakage, the display apparatus 200 can turn off at least one LED in the corner region of the displayed screen; that is, close to the corner region of the liquid crystal panel 210 while displaying the image.

While the display apparatus 200 of FIG. 2 turns off one LED of each of the LED modules 230A through 230D which is closest to each corner region of the liquid crystal panel 210 (that is, turns off four LEDs in total as shown in FIG. 2), the display apparatus 200 may turn off only one LED corresponding to the upper left corner region of the four corner regions of the liquid crystal panel 210, according to an exemplary embodiment. Also, the display apparatus 200 may turn off two LEDs closest to each of the four corner regions of the liquid crystal panel 210 (that is, turns off eight LEDs in total), according to an exemplary embodiment.

Figure 3:
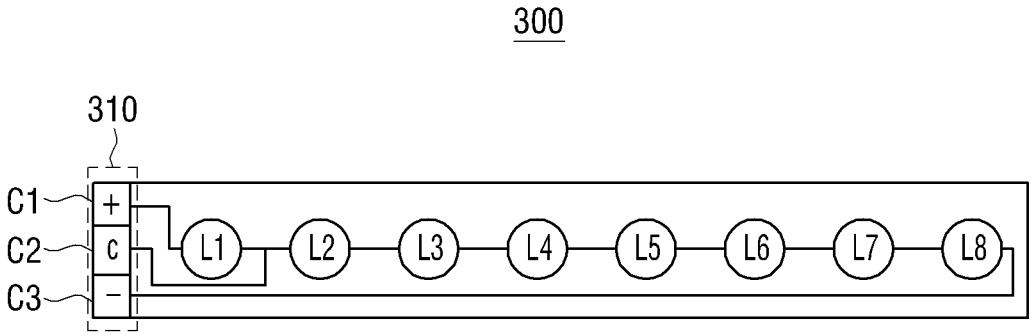
FIG. 3 illustrates an LED module according to an exemplary embodiment.

FIG. 3 illustrates a single LED module corresponding to the LED module 230A or 230C of FIG. 2, according to an exemplary embodiment.

In FIG. 3, an LED module 300 includes a plurality of LEDs L1 through L8 and a connector 310.

The LEDs L1 through L8 can be in the form of an LED string connected in series. The connector 310 supplies current applied from the driver 130 of FIG. 1, to the LEDs L1 through L8.

The connector 310 includes a first terminal C1, a second terminal C2, and a third terminal C3 of the LED module 300. The first terminal C1 is connected to an anode of the LED L1 disposed at one end among the LEDs L1 through L8. The second terminal C2 is connected to a cathode of the LED L1. The third terminal C3 is connected to a cathode of the LED L8 disposed at the other end among the LEDs L1 through L8.

Figure 4:
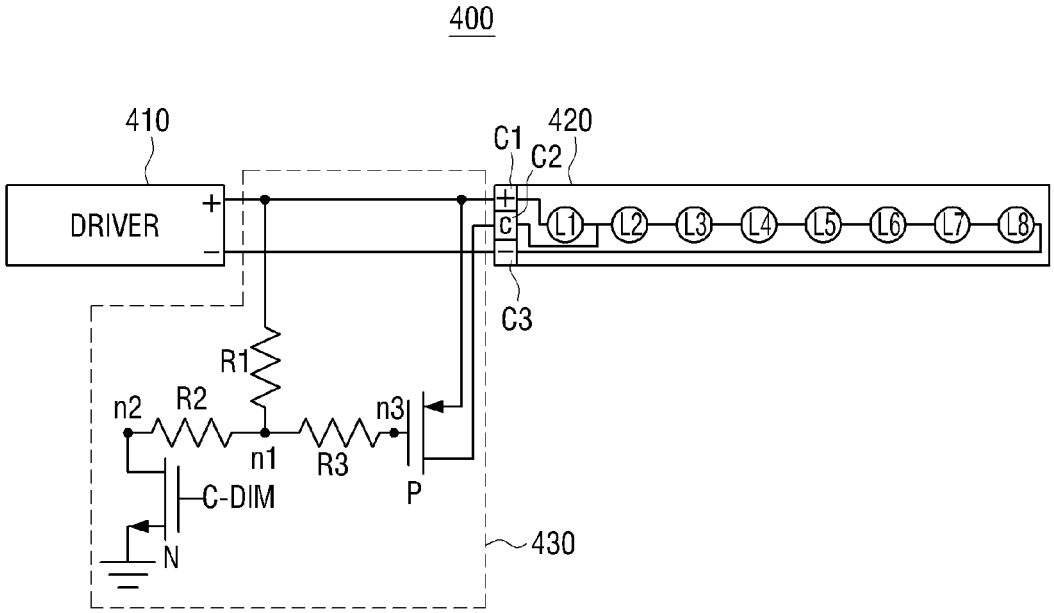
FIG. 4 illustrates a display apparatus including a single LED module operated by a driver, according to an exemplary embodiment.

FIG. 4 depicts a display apparatus including a single LED module, corresponding to the LED module 300 of FIG. 3, controlled by a driver.

In FIG. 4, a display apparatus 400 includes a driver 410, a LED module 420, and a switch unit 430 corresponding to the driver 130, the at least one LED module 120 and the switch unit 150 of FIG. 1. To ease the understanding, FIG. 4 illustrates only a part of the display apparatus 200 of FIG. 2.

A plus terminal of the driver 410 is connected to a first terminal C1 of the LCD module 420, and a minus terminal of the driver 410 is connected to a third terminal C3 of the LCD module 420.

The switch unit 430 includes a first resistor R1, a second resistor R2, a third resistor R3, a first transistor P, and a second transistor N.

The first resistor R1 is connected to the first terminal C1 of the connector at one end, and connected to a first node n1 of the switch unit 430 at the other end. The second resistor R2 is connected to the first node n1 at one end and to a second node n2 of the switch unit 430 at the other end. The third resistor R3 is connected to the first node n1 at one end to a third node n3 of the switching unit 430 at the other end.

In the first transistor P, a gate terminal is connected to the third node n3, a source terminal is connected to the first terminal C1, and a drain terminal is connected to the second terminal C2. The first transistor P can be a P-channel metal oxide semiconductor (PMOS).

In the second transistor N, a drain terminal is connected to the second node n2, an external signal C-DIM is applied to a gate terminal, and a source terminal is grounded. The second transistor N can be an N-channel MOS (NMOS).

Herein, an external signal C-DIM can be a control signal for controlling not to apply current from the driver 410 to at least one LED of the LED module 420 based on analysis of an input image by an image analyzer of the display apparatus 400 corresponding to the image analyzer 140 of FIG. 1.

While the eight LEDs L1 through L8 are illustrated in FIGS. 3 and 4, the number of the LEDs is not limited to eight.

An operation principle of the display apparatus 400, according to an exemplary embodiment, is explained by referring to FIGS. 3 and 4.

When the image analyzer confirms that the input image does not need image quality improvement to prevent light leakage, a Low value is applied to the external signal C-DIM from the image analyzer. Herein, the Low value can be a voltage value lower than a threshold which cannot turn on the second transistor N.

When the Low value is applied to the external signal C-DIM, the second transistor N is opened and the first transistor P is also opened. In result, the current applied from the plus terminal of the driver 410 can pass through the first terminal C1 of the LED module 420, the LEDs L1 through L8, and the third terminal C3 of the LED module 420 in sequence, and then, flow to the minus terminal of the driver 410.

By contrast, when the image analyzer confirms that the input image needs image quality improvement to prevent light leakage, a High value is applied to the external signal C-DIM output from the image analyzer. Herein, the High value can be a voltage value higher than the threshold which can turn on the second transistor N.

When the High value is applied to the external signal C-DIM, the second transistor N is switched on and the first transistor P is also switched on. In result, the current applied from the plus terminal of the driver 410 can pass through the first terminal C1 of the LED module 420, the second terminal C2 of the LED module 420, the LEDs L2 through L8, and the third terminal C3 of the LED module 420 in sequence and finally flow to the minus terminal of the driver 410.

Thus, the driver 410 can apply no current to the LED L1 by diverting the current.

Figure 5:
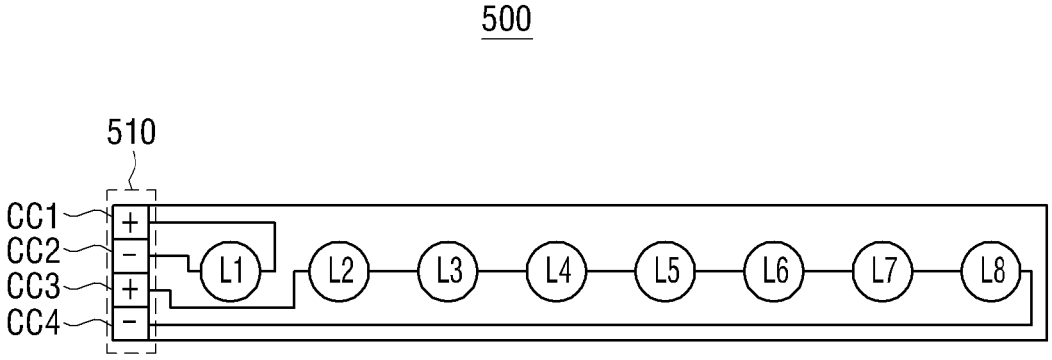
FIG. 5 illustrates another LED module according to an exemplary embodiment.

FIG. 5 illustrates another single LED module corresponding to the LED module 230A or 230C of FIG. 2, according to an exemplary embodiment.

An LED module 500 of FIG. 5 includes a plurality of LEDs L1 through L8 and a connector 510.

The LEDs L1 through L8 can include LEDs L1 through L8 interconnected in series, and be in the form of an LED string. The connector 510 supplies current applied from the driver 130 of FIG. 1 to the LEDs L1 through L8.

The connector 510 includes a first terminal CC1, a second terminal CC2, a third terminal CC3, and a fourth terminal CC4. The first terminal CC1 of the connector 510 is connected to a cathode of the LED L1 disposed at one end among the LEDs L1 through L8. The second terminal CC2 of the connector 510 is connected to an anode of the LED L1. The third terminal CC3 of the connector 510 is connected to an anode of the LED L2 of the LEDs L2 through L8 connected in series. The fourth terminal CC4 of the connector 510 is connected to a cathode of the LED L8 of the LEDs L1 through L8.

Figure 6:
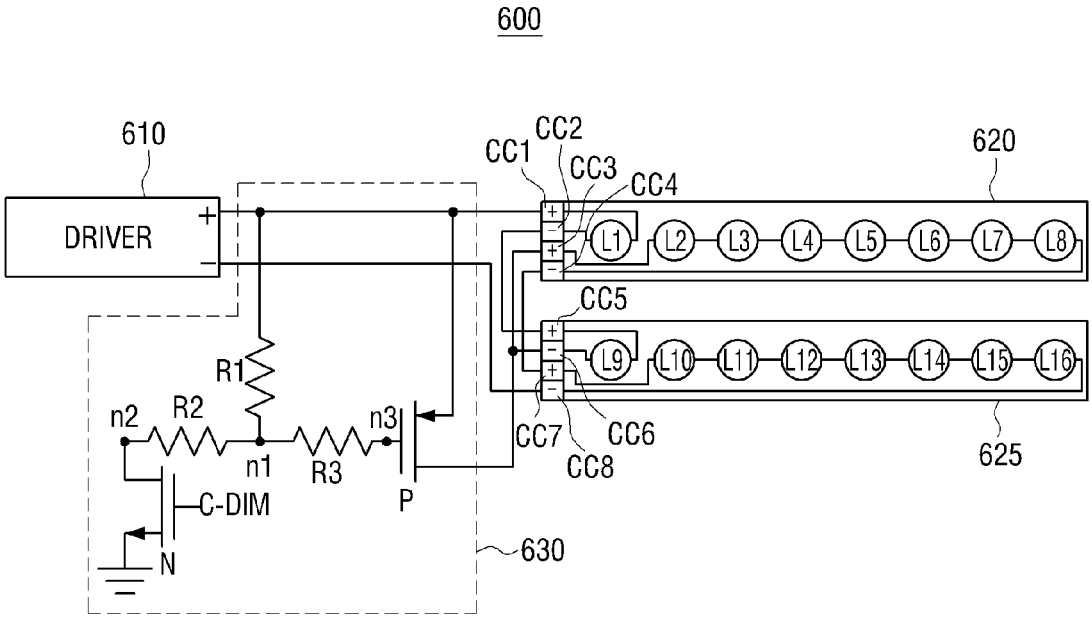
FIG. 6 illustrates a display apparatus including two LED modules operated by the driver, according to an exemplary embodiment.

FIG. 6 illustrates a display apparatus including two LED modules, corresponding to the LED module 500 of FIG. 5, controlled by a driver.

Referring to FIG. 6, a display apparatus 600 includes a driver 610, two LED modules 620 and 625, and a switch unit 630 corresponding to the driver 130, the at least one LED module 120 and the switch unit 150 of FIG. 1. To ease the understanding, FIG. 6 illustrates only a part of the display apparatus 200 of FIG. 2.

A plus terminal of the driver 610 is connected to a first terminal CC1 of the LED module 620, and a minus terminal of the driver 610 is connected to a fourth terminal CC8 of the LED module 625.

The switch unit 630 includes a first resistor R1, a second resistor R2, a third resistor R3, a first transistor P, and a second transistor N.

The first resistor R1 is connected to the first terminal CC1 of the LED module 620 at one end and connected to a first node n1 of the switch unit 630 at the other end. The second resistor R2 is connected to the first node n1 at one end and to a second node n2 of the switch unit 630 at the other end. The third resistor R3 is connected to the first node n1 at one end and to a third node n3 of the switch unit 630 at the other end.

In the first transistor P, the gate terminal is connected to the third node n3, the source terminal is connected to the first terminal CC1 of the LED module 620, and the drain terminal is connected to the third terminal CC3 of the LED module 620 and the second terminal CC6 of the LED module 625. The first transistor P can be a P-MOS.

In the second transistor N, the drain terminal is connected to the second node n2, an external signal C-DIM is applied to a gate terminal, and a source terminal is grounded. The second transistor N can be an N-MOS.

The second terminal CC2 of the LED module 620 is connected to the first terminal CC5 of the LED module 625, and the fourth terminal CC4 of the LED module 620 is connected to the third terminal CC7 of the LED module 625.

The LED module 620 and the LED module 625 have the same structure.

The LED module 620 can be the LED module 230A in FIG. 2 and the LED module 625 can be the LED module 230B in FIG. 2, according to an exemplary embodiment. According to another exemplary embodiment, the LED module 620 can be the LED module 230A in FIG. 2 and the LED module 625 can be the LED module 230C in FIG. 2. As stated above, the driver 130 can drive a plurality of the LED modules such as the LED modules 230A through 230D in FIG. 2. According to an exemplary embodiment, the LED modules can be located at various positions with respect to a light guide plate corresponding to the light guide plate 220 in FIG. 2.

While 16 LEDs are depicted in FIGS. 5 and 6, the number of the LEDs is not limited to 16. While the driver 130 drives, but not limited to, two LED modules 620 and 625 in FIG. 6, the driver 130 can drive more than two LED modules.

The operation principle of the display apparatus 600, according to an exemplary embodiment, is described by referring to FIGS. 5 and 6.

When an image analyzer of the display apparatus 600 corresponding to the image analyzer 140 of FIG. 1 confirms that an input image does not need image quality improvement to prevent light leakage, a Low value is applied to the external signal C-DIM from the image analyzer. Herein, the Low value can be a voltage value lower than a threshold which cannot turn on the second transistor N.

When the Low value is applied to the external signal C-DIM, the second transistor N is opened and the first transistor P is also opened. In result, the current applied from the plus terminal of the driver 610 can pass through the first terminal CC1 of the LED module 620, the LED L1, the second terminal CC2 of the LED module 620, the first terminal CC5 of the LED module 625, the LED L9, the second terminal CC6 of the LED module 625, the third terminal CC3 of the LED module 620, the LEDs L2 through L8, the fourth terminal CC4 of the LED module 620, the third terminal CC7 of the LED module 625, the LEDs L10 through L16, and the fourth terminal CC8 of the LED module 625 in sequence, and then, flow to the minus terminal of the driver 610.

By contrast, when the image analyzer confirms that the input image needs image quality improvement to prevent light leakage, a High value is applied to the external signal C-DIM from the image analyzer.

When the High value is applied to the external signal C-DIM, the second transistor N is switched on and the first transistor P is also switched on. In result, the current applied from the plus terminal of the driver 610 can pass through the first terminal CC1 of the LED module 620, the second terminal CC2 of the LED module 620, the third terminal CC3 of the LED module 620, the LEDs L2 through L8, the fourth terminal CC4 of the LED module 620, the third terminal CC7 of the LED module 625, the LEDs L10 through L16, and the fourth terminal CC8 of the LED module 625 in sequence, and finally, flow to the minus terminal of the driver 610.

Thus, the driver 610 can apply no current to the LED L1 and the LED L9 by diverting the current.

Figure 7A:
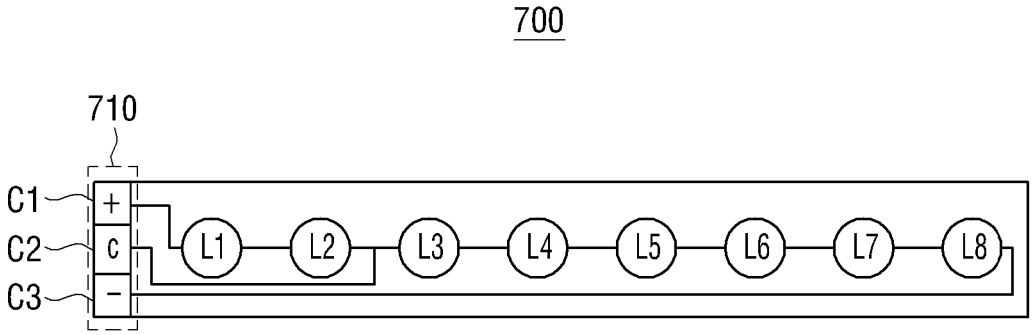
FIGS. 7A and 7B illustrate yet another LED module, according to an exemplary embodiment.
Figure 7B:
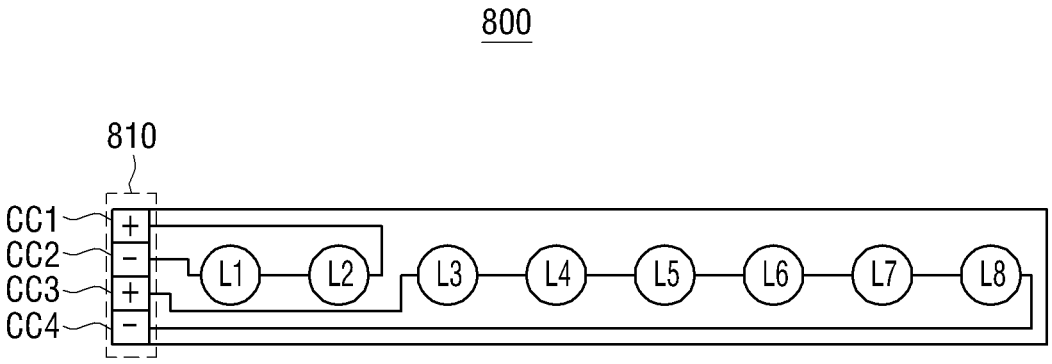

FIGS. 7A and 7B illustrate other LED modules.

An LED module 700 of FIG. 7A is modification of the LED module of FIG. 3.

In FIG. 7A, when the image analyzer of the display apparatus 400 confirms that the input image needs image quality improvement to prevent light leakage, the LED module 700 of FIG. 7A can turn off the LED L1 and the LED L2, while the LED module of FIG. 3 turns off the LED L1 alone.

An LED module 800 of FIG. 7B is modification of the LED module of FIG. 5.

Referring to FIG. 7B, when the image analyzer of the display apparatus of FIG. 6 confirms that an input image needs image quality improvement to prevent light leakage, the LED module 800 of FIG. 7B can turn off the LED L1 and the LED L2, while the LED module of FIG. 5 turns off the LED L1 alone.

By simply modifying the LED modules 700 and 800 as shown in FIGS. 7A and 7B, the number of the LEDs to turn off can be changed.

Figure 8:
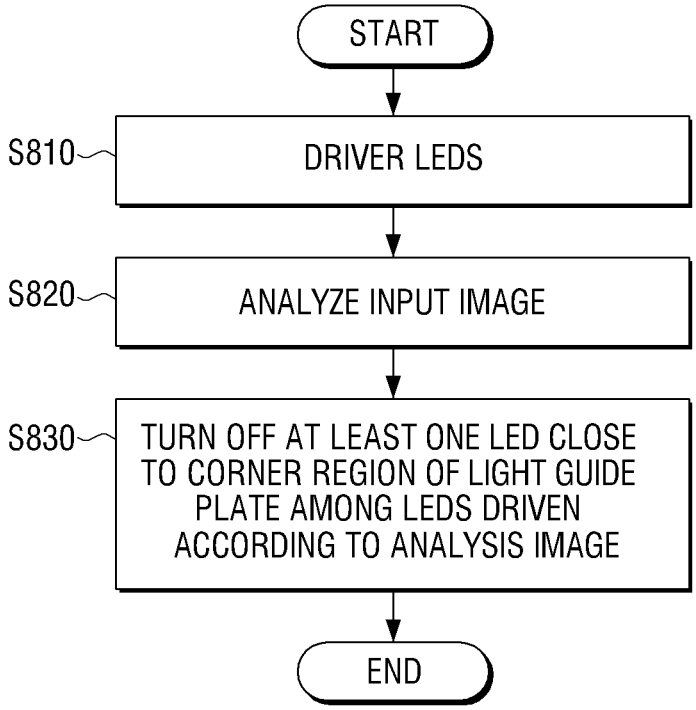
FIG. 8 is a flowchart of a method for improving image quality of the display apparatus, according to an exemplary embodiment.

FIG. 8 is a flowchart of a method for improving image quality of a display apparatus corresponding to the display apparatuses as shown in FIGS. 1-7B, according to an exemplary embodiment. The display apparatus in the present exemplary embodiment includes the same or similar components constituting the display apparatuses as shown in FIGS. 1-7B, and thus, the image quality improvement method according to the present exemplary embodiment is described herebelow in reference to these components of the display apparatuses as shown in FIGS. 1-7B.

The image quality improvement method of the display apparatus includes driving a plurality of the LEDs (S810), analyzing an input image (S820), and turning off at least one LED close to a corner region(s) of a liquid crystal panel, among the plurality of the LEDs, according to the image analysis (S830).

The display apparatus for image quality improvement method in the present exemplary embodiment includes a liquid crystal panel, a light guide plate arranged in parallel with the liquid crystal panel in the rear side of the liquid crystal panel, and at least one LED module disposed in at least one side of the light guide plate and including a plurality of the LEDs.

In the turning off operation (S830), no current is applied to at least one LED, close to a corner region(s) of the liquid crystal panel, by diverting the current applied from the driver.

Figure 9:
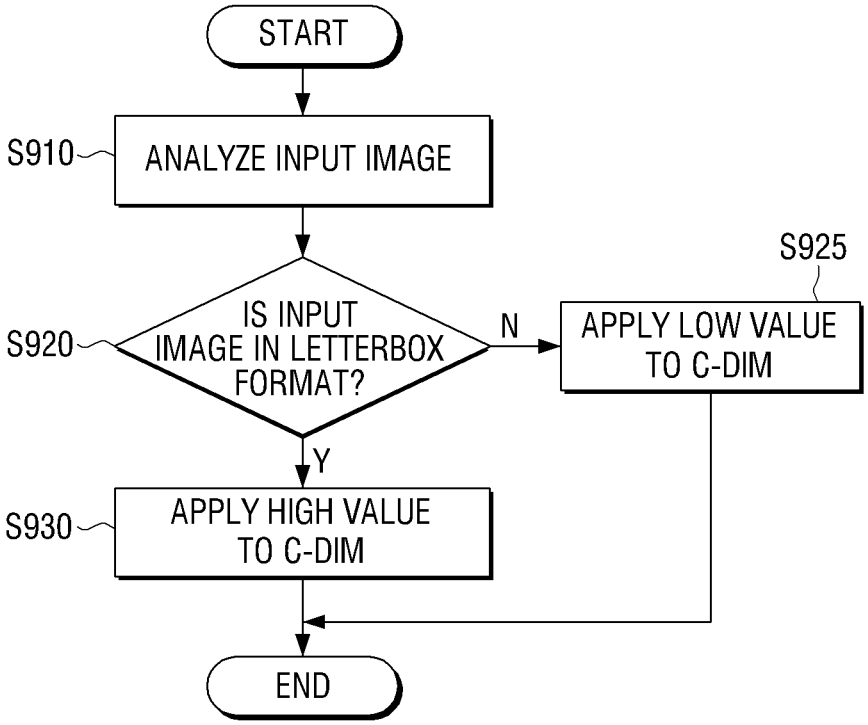
FIG. 9 is a flowchart of a method for analyzing an image, according to an exemplary embodiment.

FIG. 9 is a flowchart of a method for analyzing an input image in reference to the display apparatuses as shown in FIGS. 1-7B, according to an exemplary embodiment.

The image analyzer 140 analyzes an input image (S910) and checks whether the input image is a letterbox format image (S920).

When the input image is the letterbox format image, the High value is applied to the external signal C-DIM, as shown in FIGS. 4 and 6, which is a signal output from the image analyzer 140 (S930). When the input image is not the letterbox format image, the Low value is applied to the external signal C-DIM which is the signal output from the image analyzer 140 (S925).

Still referring to FIG. 9, the display apparatus 100 using the edge-type LEDs can suffer from light leakage in a corner region(s) of the liquid crystal panel 105. The corner region(s) indicates each vertex in the display screen of the display apparatus 100. When the display screen is a quadrangle, four vertex regions each can be the corner region(s).

When the display apparatus 100 displays a letterbox format image, four corner regions of the display screen can be displayed black. When the four corner regions are displayed brightly, it is hard to perceive light leakage with eyes. When the four corner regions are displayed darkly, it is quite easy to perceive light leakage with eyes. Accordingly, when the letterbox format image is input, the image analyzer 140 can turn off at least one LED corresponding to the four corner regions by applying the High value to the external signal C-DIM.

The foregoing embodiments and advantages are merely exemplary and are not to be construed as limiting the inventive concept. For example, the light sources to implement the exemplary embodiments are not limited to the LEDs. The foregoing exemplary embodiments can be readily applied to other types of apparatuses. Also, the descriptions of the foregoing exemplary embodiments are intended to be illustrative, and not to limit the scope of the claims, and many alternatives, modifications, and variations will be apparent to those skilled in the art.

What is claimed is:

1. A display apparatus comprising:

a liquid crystal panel;

a light guide plate disposed at a rear side of the liquid crystal panel;

at least one LED module disposed in at least one side of the light guide plate comprising:

a plurality of LEDs;

a first terminal connected to an anode of a first LED placed at one end of the plurality of LEDs connected in series, a second terminal connected to a cathode of the first LED, and a third terminal connected to a cathode of a last LED placed at the other end of the plurality of LEDs connected in series;

a driver which drives the plurality of LEDs comprising:

a plus terminal and a minus terminal, wherein the first terminal is connected to the plus terminal, and the third terminal is connected to the minus terminal;

an image analyzer which analyzes an input image; and a switch unit which comprises:

a first resistor directly connected to the first terminal at one end and to a first node at the other end, a second resistor directly connected to the first node at one end and to a second node at the other end, a third resistor directly connected to the first node at one end and to a third node at the other end, a first transistor directly connected to the third node at a gate terminal, to the first terminal at a source terminal, and to the second terminal at a drain terminal, and a second transistor directly connected to the second node at a drain terminal, an external signal being applied to a gate terminal of the second transistor, and a source terminal of the second transistor being grounded, wherein, according to a result of the analyzing the input image, the switch unit turns off at least one LED among the plurality of LEDs while the driver drives a remainder of the plurality of LEDs, wherein the at least one LED is disposed closer to a corner of the liquid crystal panel than the remainder of the plurality of LEDs.

2. The display apparatus of claim 1, wherein the first transistor is a P-channel metal oxide semiconductor (PMOS) and the second transistor is an N-channel metal oxide semiconductor (NMOS).

3. The display apparatus of claim 1, wherein the external signal is a control signal which controls not to apply current to the at least one LED, based on a result of the analyzing the input image.

4. The display apparatus of claim 1, wherein the at least one LED module comprises a first LED module and a second LED module, and the plurality of LEDs comprises a first plurality of LEDs included in the first LED module and a second plurality of LEDs included in the second LED module, wherein the first LED module comprises a first terminal, a second terminal, a third terminal, and a fourth terminal, wherein the first terminal is connected to a cathode of a first LED placed at one end of the first plurality of LEDs connected in series, the second terminal is connected to an anode of the first LED, the third terminal is connected to an anode of a second LED connected to the first LED, and the fourth terminal is connected to a cathode of a last LED placed at the other end of the first plurality of LEDs connected in series.

5. The display apparatus of claim 4, wherein the second LED module has the same structure as the first LED module.

6. The display apparatus of claim 1, wherein the switch unit turns off the at least one LED while the remainder of the plurality of LEDs are being driven by the driver when the image analyzer determines at least one of:

(i) that the input image to be displayed on the liquid crystal panel is in a given format; and (ii) that a pixel value of the input image to be displayed at the corner of the liquid crystal panel is lower than a pixel value of the input image to be displayed at a neighbor region.

7. The display apparatus of claim 6, further comprising a storage unit which pre-stores information which the image analyzer uses to determine the at least one of (i) and (ii).

8. The display apparatus of claim 6, wherein the given format is a letterbox format.

9. The display apparatus of claim 1, further comprising a storage unit which pre-stores information about the at least one LED to be turned off according to the result of the analyzing the input image.

10. The display apparatus of claim 9, wherein the pre-stored information about the at least one LED to be turned off comprises information about at least one of a location of the at least one LED in the at least one LED module and a number of the at least one LED among the plurality of LEDs.

11. The display apparatus of claim 1, further comprising a user input unit which receives a user command to control the switch unit to turn off the at least one LED without regard to the result of the analyzing the input image.

12. A display apparatus comprising:

a display substrate on which an input image is displayed;

a light guide plate disposed at a rear side of the display substrate;

at least one light source module disposed in at least one side of the light guide and comprising:

a plurality of light sources;

a first terminal connected to an anode of a first light source placed at one end of the plurality of light sources connected in series, a second terminal connected to a cathode of the first light source, and a third terminal connected to a cathode of a last light source placed at the other end of the plurality of light sources connected in series; and a controller comprising:

a plus terminal and a minus terminal, wherein the first terminal is connected to the plus terminal, and the third terminal is connected to the minus terminal;

a first resistor directly connected to the first terminal at one end and to a first node at the other end, a second resistor directly connected to the first node at one end and to a second node at the other end, a third resistor directly connected to the first node at one end and to a third node at the other end, a first transistor directly connected to the third node at a gate terminal, to the first terminal at a source terminal, and to the second terminal at a drain terminal, and a second transistor directly connected to the second node at a drain terminal, an external signal being applied to a gate terminal of the second transistor, and a source terminal of the second transistor being grounded, wherein the controller turns on and off at least one light source among the plurality of light sources while a remainder of the plurality of light sources are turned on to display the input image on the display substrate.

13. The display apparatus of claim 12, further comprising at least one of an image analyzer, which analyzes the input image, and a user input which receives a user command, wherein the at least one light source to be turned on and off is selected by the controller according to a result of the analyzing the input image or the user command.

14. The display apparatus of claim 12, wherein the controller turns off the at least one light source while the remainder of the plurality of light sources are turned on to display the input image, when it is determined that light leakage blurring the display substrate is to occur at a region of the display substrate which is disposed closer to the at least one light source than a remaining region of the display substrate.

15. The display apparatus of claim 13, wherein the controller turns off the at least one light source while the remainder of the plurality of light sources are turned on to display the input image when the image analyzer determines at least one of:

(i) that the input image to be displayed on the display substrate is in a given format; and (ii) that a pixel value of the input image to be displayed at a region in the display substrate corresponding to the at least one light source is lower than a pixel value of the input image to be displayed at a neighbor region in the display substrate.

16. The display apparatus of claim 15, further comprising a storage substrate which pre-stores information required by the image analyzer to determine the at least one of (i) and (ii).

* * * * *